US005730696A

United States Patent [19]

Simmons

[11] Patent Number: 5,730,696

[45] Date of Patent: Mar. 24, 1998

[54] CUSHIONING CONVERSION MACHINE SELECTIVELY PIVOTABLE IN A HORIZONTAL PLANE

[75] Inventor: James A. Simmons, Painesville Township, Ohio

[73] Assignee: Ranpak Corp., Concord Township, Ohio

[21] Appl. No.: 482,826

[22] Filed: Jun. 7, 1995

[51] Int. Cl.[6] ..... B31B 1/00

[52] U.S. Cl. ..... 493/478; 493/464; 493/967; 493/477

[58] Field of Search ..... 493/464, 468, 493/471, 473, 475, 476, 477, 478, 479, 480, 907; 248/122.1, 125.1, 175.3, 125.7, 408, 415, 416, 418, 125.3

[56] References Cited

U.S. PATENT DOCUMENTS

| | | | |
|---|---|---|---|
| 2,469,904 | 5/1949 | Szuba | 248/124 |
| 3,162,922 | 12/1964 | Alziari | 248/125.3 |
| 3,212,748 | 10/1965 | Faurot | 248/458 |
| 3,391,889 | 7/1968 | Stewart | 248/221 |
| 4,226,390 | 10/1980 | Steggall | 248/124 |
| 5,123,889 | 6/1992 | Armington | 493/352 |
| 5,255,627 | 10/1993 | Williams | 248/418 |
| 5,322,477 | 6/1994 | Armington | 493/346 |
| 5,468,208 | 11/1995 | Armington | 493/352 |
| 5,487,717 | 1/1996 | Tekavec | 493/352 |

*Primary Examiner*—Joseph J. Hail, III
*Assistant Examiner*—Christopher W. Day
*Attorney, Agent, or Firm*—Renner, Otto, Boisselle & Sklar, P.L.L.

[57] ABSTRACT

A cushioning conversion system (10) including a stand (12), a cushioning conversion machine (14), and a machine mounting assembly (16) which mounts the machine to the stand in such a manner that the machine may be selectively rotated relative to the stand in a horizontal plane.

17 Claims, 6 Drawing Sheets

CUSHIONING CONVERSION MACHINE SELECTIVELY PIVOTABLE IN A HORIZONTAL PLANE

FIELD OF THE INVENTION

This invention relates generally as indicated to a cushioning conversion system and, more particularly, to a system including a stand, a cushioning conversion machine, and a machine mounting assembly which mounts the machine to the stand in such a manner that the machine may be selectively rotated relative to the stand in a horizontal plane.

BACKGROUND AND SUMMARY OF THE INVENTION

In this process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without advantages. Perhaps the most serious drawback of plastic bubble Wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alterative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4,026,198; 4,085,662; 4,109,040; 4,237,776; 4,557,716; 4,650,456; 4,717,613; 4,750,896; 4,968,291; and 5,123,889. (These patents are all assigned to the assignee of the present invention and their entire disclosures are hereby incorporated by reference.) Such a cushioning conversion machine converts sheet-like stock material, such as paper in multi-ply form, into low density cushioning pads.

A cushioning conversion machine, such as those disclosed in the above-identified patents, includes a machine frame having an upstream end and a downstream end. ("Upstream" and "downstream" in this context corresponds to the flow of stock material through machine.) The conversion assembly of such a machine may include a stock assembly, a forming assembly, a feed assembly, and a cutting assembly, some or all of which are mounted on the machine's frame. During operation of such a cushioning conversion machine, the stock supply assembly supplies the stock material to the forming assembly. The forming assembly causes inward rolling of the lateral edges of the sheet-like stock material to form a three-dimensional strip of dunnage. The feed assembly pulls the stock material from the stock supply assembly and advances it through the forming assembly to form the continuous strip. The dunnage strip then travels downstream to the cutting assembly which cuts the coined strip into pads of a desired length.

In the past, cushioning conversion machines have been designed to be self-supporting whereby no stand structure is required. (See e.g., U.S. Pat. No. 4,968,291.) In a recent design, disclosed in U.S. Pat. No. 5,123,889, the machine may be incorporated into a cushioning conversion system including a stand which positions the machine in the desired orientation. In the latter design, the machine may be positioned in either a horizontal or vertical orientation. (In the horizontal orientation, an imaginary line from the machine's upstream end to its downstream end is substantially horizontal; in the vertical orientation, an imaginary line from the upstream end to the downstream end is substantially vertical.)

Applicant appreciated that in a cushioning conversion system, various orientations of the machine may be desirable in different situations, depending on environmental concerns, such as the predetermined location of packaging stations and/or space constraints. Applicant also appreciated that, in certain situations, various orientations of the cushioning conversion machine may be desirable to accommodate loading and/or servicing of the machine. In the past, some of these concerns have been addressed by cushioning conversion systems which allow vertical adjustment of the machine relative to the stand and/or rotational adjustment of the machine relative to the stand in a vertical plane. (See e.g., U.S. Pat. No. 5,123,889.)

Applicant further appreciated that certain situations may require rotational adjustment of the machine relative to the stand in a horizontal plane and that this requirement was not satisfied by the cushioning conversion systems discussed above. Accordingly, the present invention provides a cushioning conversion system comprising a stand, a cushioning conversion machine, and a machine mount. The machine mount couples the machine to the stand in such a manner that the machine may be selectively pivoted relative to the stand in a horizontal plane. In the preferred embodiment, the machine is horizontally oriented and the stand comprises a vertical member to which the machine mounting assembly, and thus the machine, is rotatably coupled. Also, the machine is preferably rotatable 360° and the mounting assembly includes a first set of components which may mate with any one of a second set of components to secure the mount, and thus the machine, in a plurality of rotational positions.

These and other features of the invention are fully described and particularly pointed out n the claims. The following description and annexed drawings set forth in detail one illustrative embodiment, this embodiment being indicative of but one of the various ways in which the principles of the invention may be employed.

DETAILED DESCRIPTION

Figure 1:
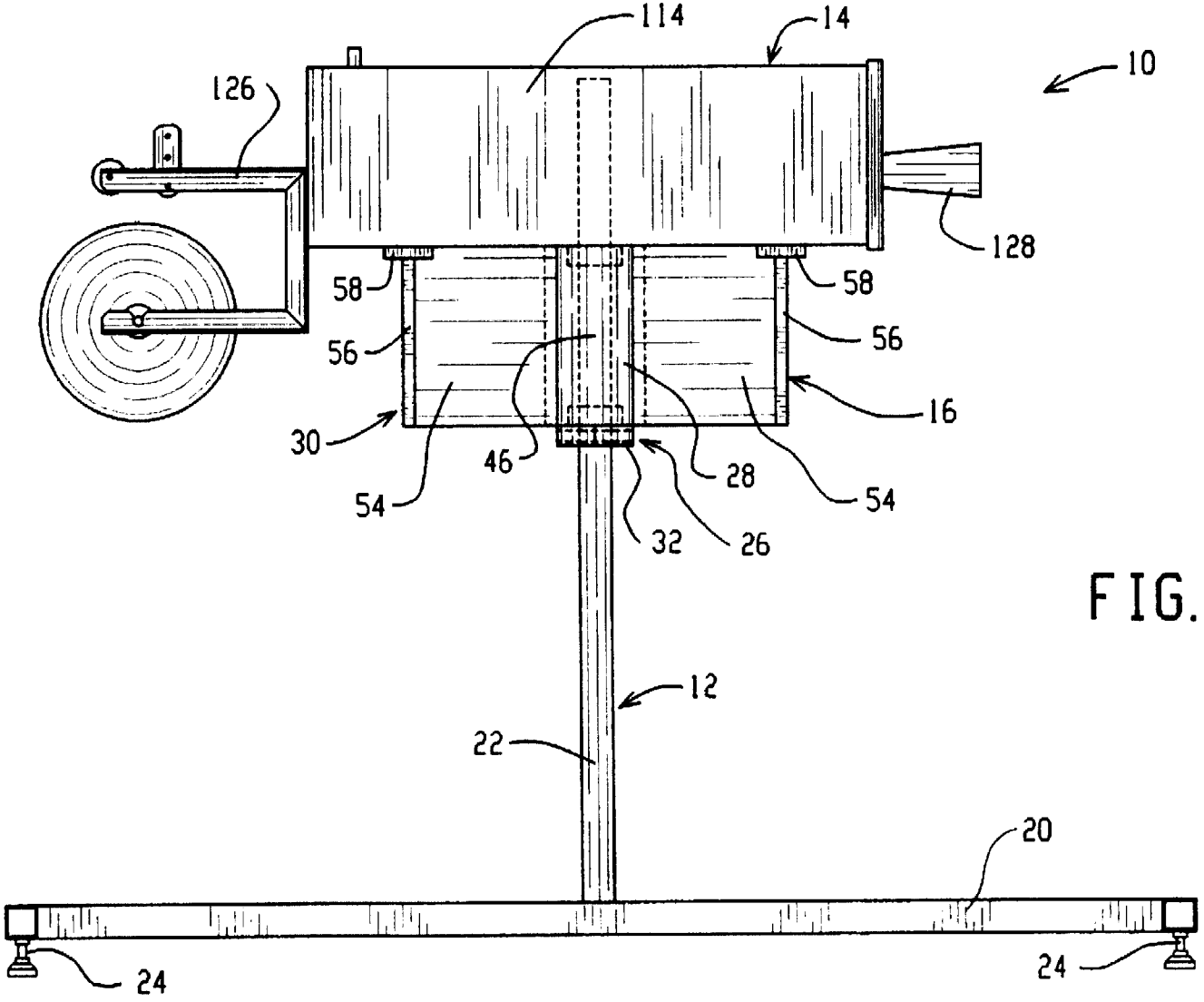
FIG. 1 is a side view of a cushioning conversion system according to the present invention, the system including a stand, a cushioning conversion machine, and a mount which mounts the stand in such a manner that the machine may be selectively rotated relative to the stand in a horizontal plane.

Referring now to the drawings in detail and initially to FIGS. 1–4, a cushioning conversion system 10 according to the present invention is shown. The system 10 comprises a stand 12, a cushioning conversion machine 14, and a machine mounting assembly 16 which mounts the machine to the stand in such a manner that the machine 14 may be selectlvely rotated related to the stand 12 in a horizontal plane. (Compare FIGS. 3 and 4.)

The stand 12 includes an H-shaped base member 20 and a vertical member 22. The base member 20 is made of square steel tubing and may include leveling feet, or pads, 24 for slight leveling adjustments of the stand 12 at the packaging site. The vertical member 22 is made of steel, is circular in cross-section, and extends upward from an intermediate portion of the center leg of the "H" of the base member 20.

As discussed in more detail below in conjunction with FIG. 6, the cushioning conversion machine 14 converts sheet-like stock material into a dunnage product. In the illustrated and preferred system 10, the machine 14 is positioned in a substantially horizontal orientation. In other words, an imaginary line from the machine's upstream end to its downstream end would be substantially horizontal.

The machine mounting assembly 16 includes a coupling unit 26, a rotating unit 28, and a platform unit 30. The coupling unit 26 is non-rotatably, but vertically adjustably, coupled to the stand's vertical member 22, and thus the stand 12. The rotating unit 28 is coupled to the coupling unit 26 for selective rotation in a horizontal plane relative to the coupling unit 26 (and therefore the vertical member 22 and the stand 12). The platform unit 30 is fixedly coupled to the rotating unit 28 and, as explained in more detail below, provides a platform for the cushioning conversion machine 14. Thus, in the cushioning conversion system 10, the machine 14 is selectively rotatable in a horizontal plane, and also vertically adjustable, relative to the stand 12.

Figure 5:
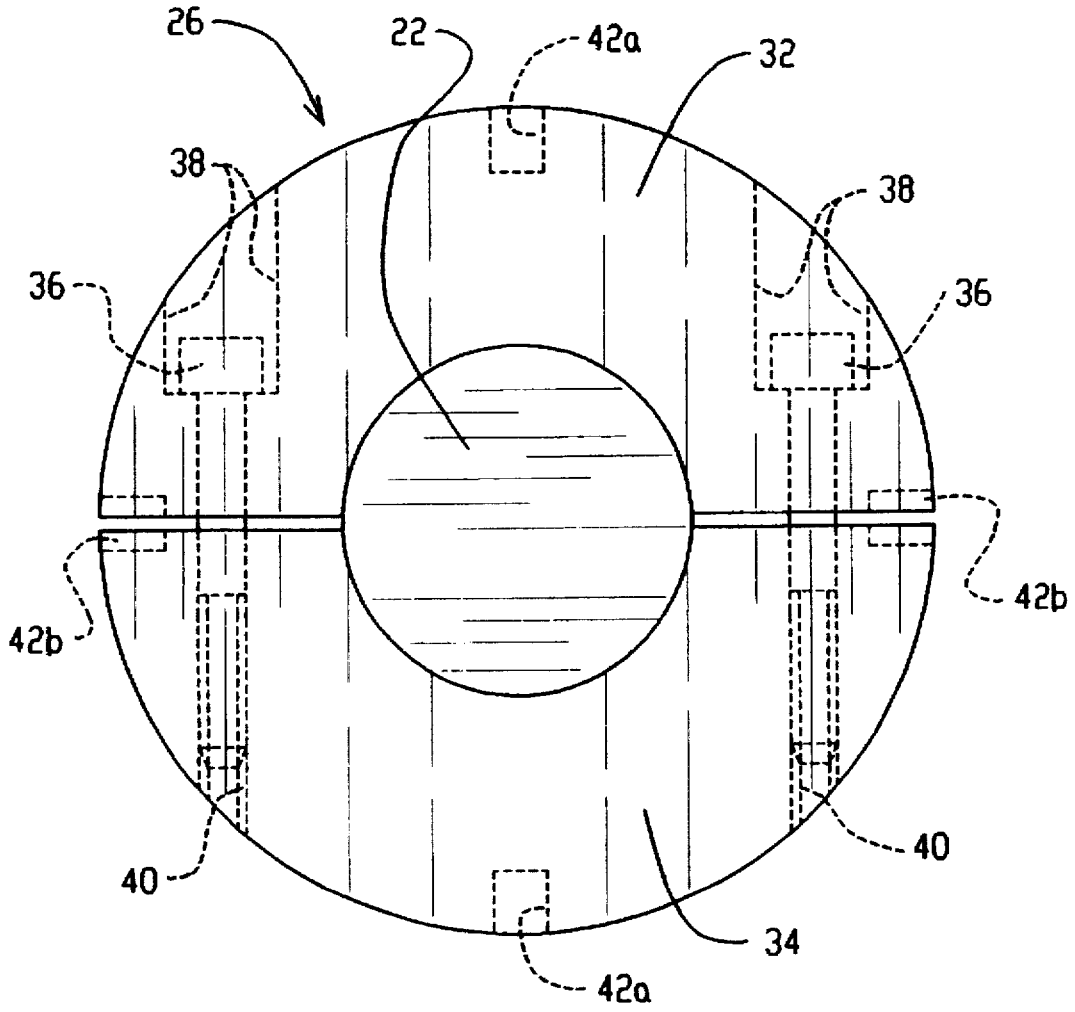
FIG. 5 is a top view of coupling unit of the mount, the unit being shown isolated from the other components of the cushioning conversion system except for a vertical member of the stud.

Referring now to FIG. 5, the coupling unit 26 is shown in more detail, and isolated from the other components of the system 10 except for the stand's vertical member 22. As illustrated, the coupling unit 26 includes two semi-circular (in cross section) collars 32 and 34 which clamp together around the stand's vertical member 22. This clamping is accomplished by a pair of bolts 36 which extend through aligned bores 38 and 40 in the collars 32 and 34, respectively. The bores 38 in collar 32 are wider at their radially outer portions to create a counterbore to accommodate the heads of the bolts 36. The bores 40 in the collar 34 are threaded at their radially outer portions to accommodate the threaded tails of the bolts 36.

The coupling unit 26 further includes four stop slots 42 spaced at 90° increments along its outer circumference. Each of the collars 32 and 34 includes a full central slot **42*a* and a pair of "half slots" 42*b* on each end. As is best shown in the drawing, the adjacent half slots 42*b* on the two collars join to form a full slot. The stop slots 42 coordinate with the rotating unit 28 to secure the mount 16 (and thus the machine 14**) at the desired rotational position, as is explained in more detail below.

Figure 2:
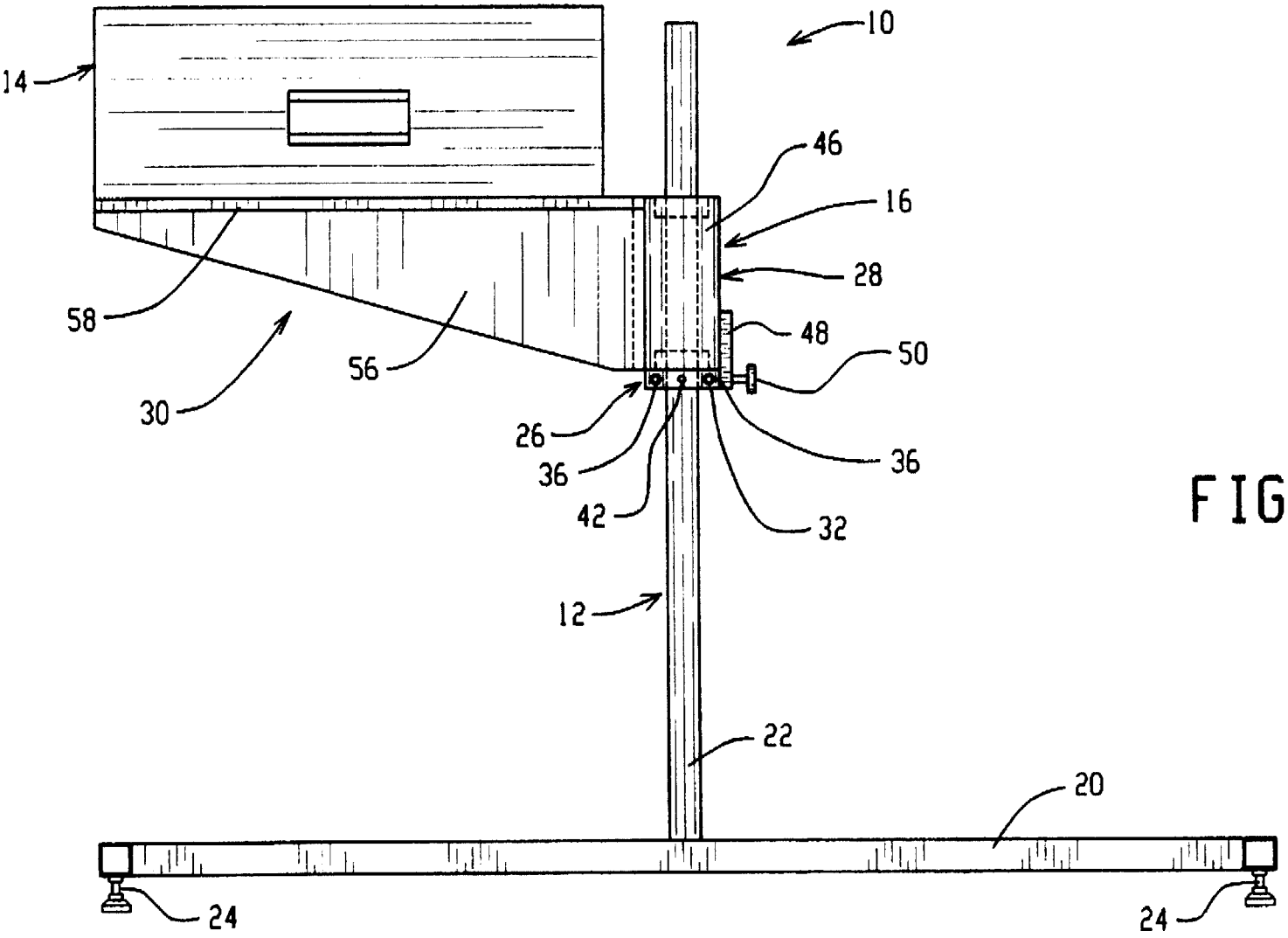
FIG. 2 is an end view of the cushioning conversion system shown in FIG. 1.

Returning now to FIGS. 1–4, it may be seen that the rotating unit 28 comprises tubular member 46 designed to rotate about the stand's vertical member 22. Although not specifically shown in the drawings, bearings would preferably be used to accomplish this rotational coupling. More preferably, thrust bearings would be used in view of the sometimes substantial weight (300 to 400 pounds) of the machine 14 As is best seen in FIG. 2, the tubular member 46 rests upon the coupling unit 26 and thus is supported thereby on the stand's vertical member 22.

The rotating unit 28 further comprises a stop plate 48 fixedly mounted (such as by welding) to the lower end of the tubular member 46 which carries a spring plunger 50. As is best seen in FIG. 2, the spring plunger 50 is positioned for selective insertion into the stop slots 42 of the coupling unit 26 to lock the rotating unit 28 at a desired rotational orientation.

The platform unit 30 includes a pair of symmetrical mounting plates 54, a pair of side gussets 56, and a pair of shelf bars 58. The mounting plates 54 are made of steel and are L-shaped in cross-section. The inner side of one leg of each of the plates 54 is welded to the tubular member 46. The distal ends of the other legs of the mounting plates 54 are attached (such as by welding) to the proximal end of the side gussets 56. (See FIGS. 3 and 4.)

The side gussets 56 are made of steel and are of a roughly triangular shape which tapers outwardly from their attachment with the mounting plates 54. (See FIG. 2.) One shelf bar 58 is attached (such as by welding) to the upper edge of each of the side gussets 56. (See FIGS. 3 and 4.) Thus, the mounting plates 54 and the said gussets 56 coordinate to support the shelf bars 58.

The shelf bars 58 are also made of steel and together form a "shelf" or "platform" upon which the cushioning conversion machine 14 rests. (See FIGS. 1 and 2.) Although not specifically shown in the drawings, coupling components may be provided to releasably mechanically couple the machine 14 to the shelf bars 58. In the illustrated and preferred embodiment, the machine 14 is positioned transversely relative to the shelf bars 58. In other words, an imaginary line from the machine's upstream end to its downstream end would be perpendicular to the shelf bars 58.

Figure 3:
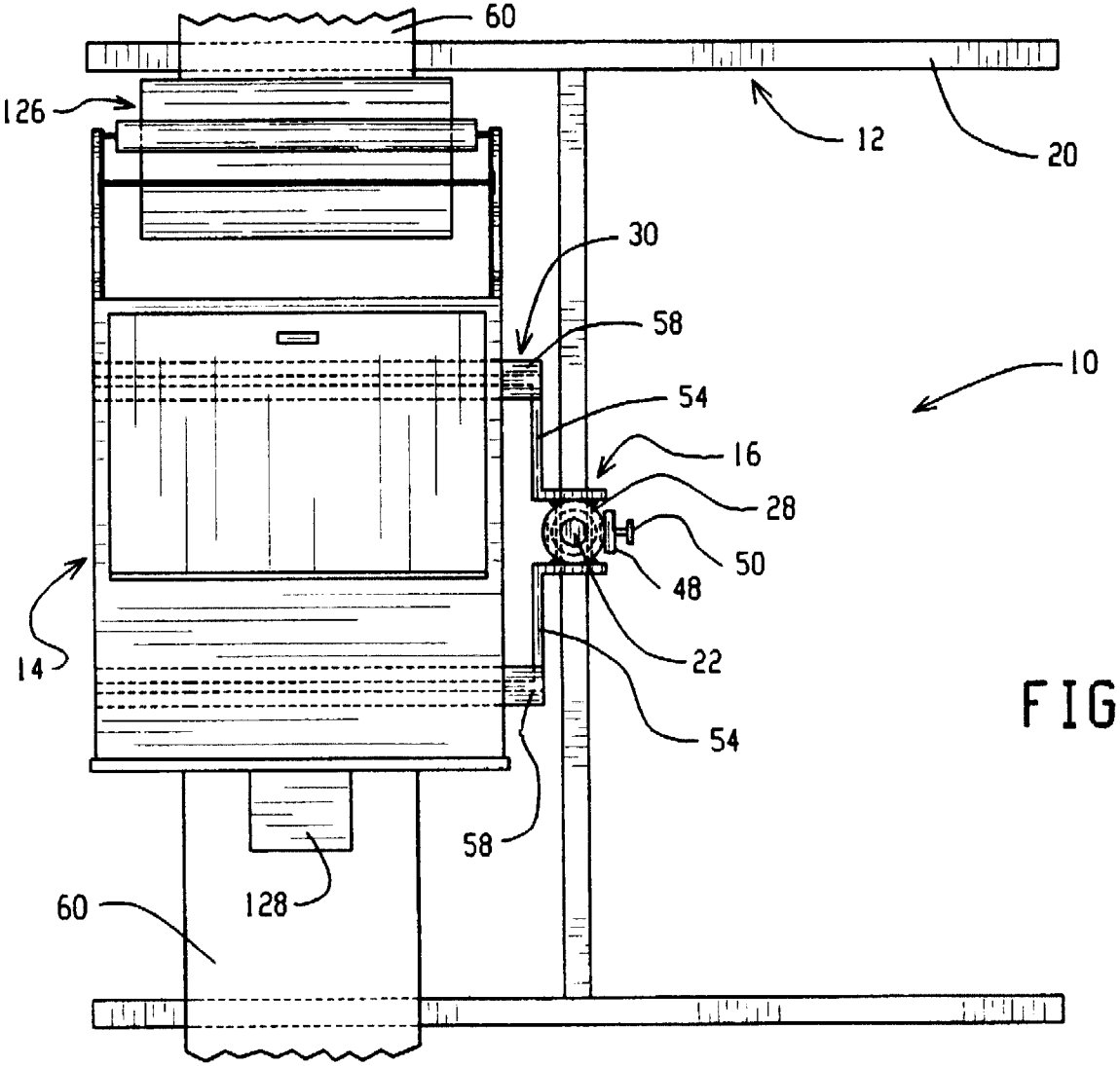
FIG. 3 is a top view of the cushioning conversion system shown in FIGS. 1 and 2, the system being shown in conjunction with a conveyor.

To use the cushioning conversion system 10, the stand 12 would be appropriately positioned relative to a packaging surface and the machine 14 rotated in a horizontal plane to the desired orientation. In the example shown in FIGS. 3 and 4, the packaging surface is a conveyor 60. The stand 12 is positioned so that the side legs of the H-shaped base member 20 are positioned partially under the conveyor 60 and the center leg of the "H" is adjacent to, and parallel with, the conveyor 60. In FIG. 3, the machine mount 16 is rotated to situate the machine 14 above and parallel to the conveyor 60. In other words, a line from the machine's upstream end to its downstream end would be parallel with the conveyor 60 and also the center leg of the stand's base member 20. In this manner, dunnage products produced by the machine 14 would be deposited on the conveyor 60.

Figure 4:
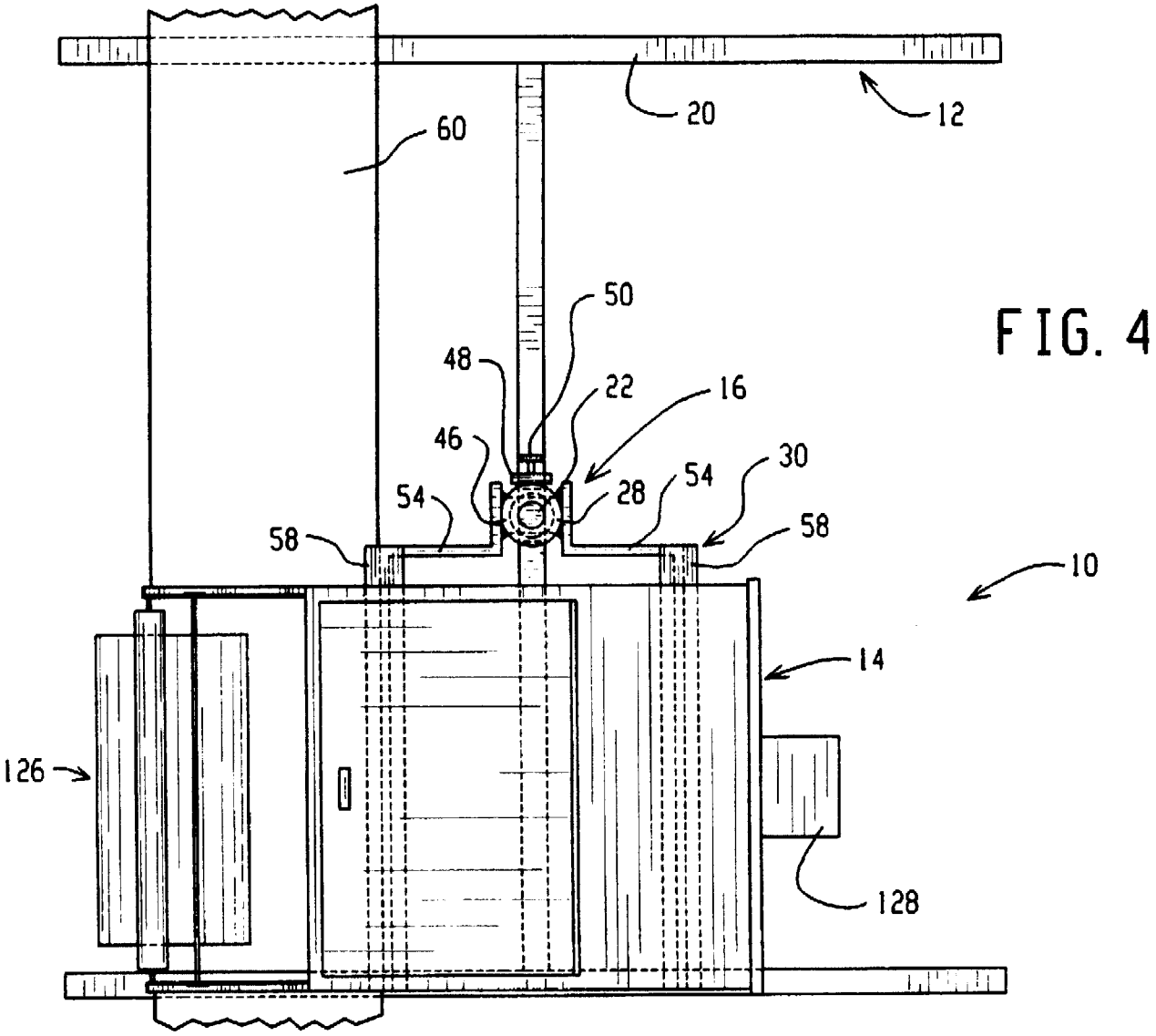
FIG. 4 is another top view of the cushioning conversion system in conjunction with a conveyor, the machine being shown rotated 90° counterclockwise relative to the stand from the position shown in FIG. 3.

In FIG. 4, the machine 14 is shown rotated 90° counterclockwise relative to the stand 12 and the conveyor 60. This rotation is accomplished by removing the spring plunger 50 from the stop slot 42 on the coupling unit 26, rotating the rotating unit 28 (and thus the platform unit 30 and the machine 14) counterclockwise 90° and re-inserting the spring plunger 50 into the circumferentially adjacent stop slot 42.

When the machine 14 is rotated to the position shown in FIG. 4, the downstream portion of the machine 14 is no longer positioned above the conveyor 60 whereby, for instance, downstream components of the machine (such as the cutting assembly discussed below) may be more accessible for servicing. Likewise, if the machine 14 was rotated 90° clockwise from its original position shown in FIG. 3, the upstream portion on the machine 14 would be positioned away from the conveyor 60 whereby, for instance, loading of the machine may be more convenient. Also, if the machine 14 was rotated another 90° counterclockwise from the position shown in FIG. 4, the entire machine would be positioned away from the conveyor belt for overall servicing. In any event, after the servicing/loading tasks are completed, the machine 14 could be rotated back to its original position shown in FIG. 3

It should be noted at this point that although four equally circumferentially spaced stop slots 42 are shown in the illustrated embodiment, other arrangements, both equally circumferentially spaced or otherwise, are possible with, and contemplate by, the present invention. In fact, the present invention contemplates any system in which a first set of components mate with any one of second set of components to secure the mount, and thus the machine, in a plurality of rotational positions.

As was indicated above, the machine mount 16 allows vertical adjustment of the machine 14 relative to the stand 12. To vertically adjust the height of the machine 14, the bolts 36 of the coupling unit 26 would be loosened, the collars 32 and 34 move to the desired height and then the bolts 36 re-tightened. The machine 14 and/or the units 28 and 30 would be desirably independently supported during this height adjustment process.

Figure 6:
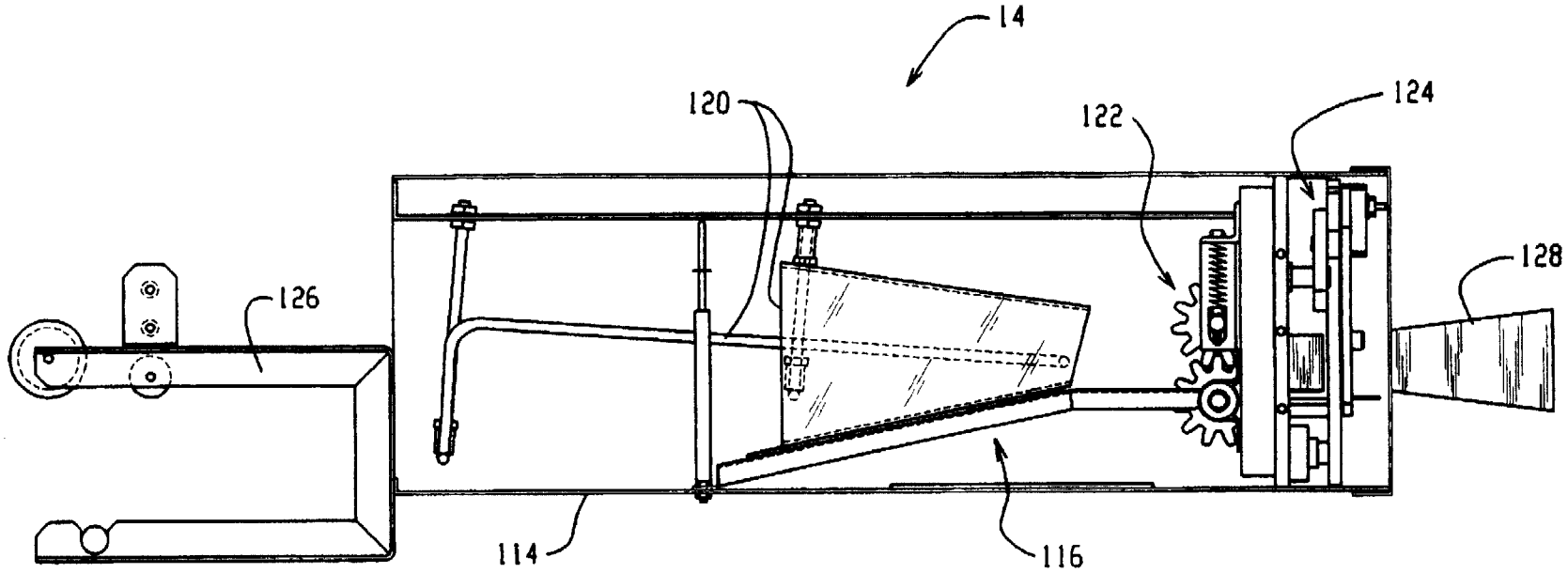
FIG. 6 is a detailed side view of the cushioning conversion machine.

Referring now additionally to FIG. 6, the cushioning conversion machine 14 is shown in detail. The machine 14 includes a frame 114 and a conversion assembly 116 mounted to the frame. The conversion assembly 116 converts sheet-like stock material into a cushioning product. In the preferred embodiment, the machine 14 converts multiple plies of recyclable and reusable Kraft paper into a continuous strip of dunnage two lateral pillow-like portions separated by a thin central band. However, the invention may be used in association with other forms of conversion assemblies. Consequently, the term "conversion assembly" is hereby defined as any assembly or any collection of assemblies (regardless of whether it is/they are structurally equivalent to the disclosed conversion assembly/assemblies) which converts a sheet-like stock material into a dunnage product.

The conversion assembly 116 includes a forming assembly 120 which is mounted to the frame 114. The forming assembly 120 includes a converging chute and a triangular shaped former which extends partway into the chute through the wider upstream end thereof. During conversion process, the forming assembly 120 causes inward rolling of the lateral sides of the sheet-like stock material to form a continuous strip having two lateral pillow-like portions and a central band therebetween. Details of such a assembly are set forth in U.S. Pat. No. 4,750,896, which has been incorporated by reference.

The conversion assembly 116 also includes a feed assembly 122 which is mounted to the frame 114, preferably downstream of the forming assembly 120. The feed assembly 122 advances the stock material through the forming assembly 120. In the illustrated embodiment, the feed assembly 122 is a pulling/connecting assembly which includes a pair gears between which the stock material passes. Specifically, the feed assembly 122 performs a "pulling" function by drawing the continuous strip through the nip the two cooperating and opposed gears thereby pulling the stock material through the forming assembly 120. Also, the feed assembly 122 performs a "connecting" function when the two opposing gears connect, or more particularly coin, the central band of the continuous strip as it passes therethrough. The preferred gears are disclosed in U.S. Pat. No. 4,968,291 which has been incorporated by reference.

The cushioning conversion machine 14 additionally includes a cutting assembly 124 which cuts the strip into sections of a desired length. The cutting assembly 124 is positioned downstream of the forming assembly 120 and the feed assembly 122. The preferred cutting assembly 124 is disclosed in detail in co-owned and co-pending U.S. application Ser. No. 08/188,305 to Simmons, entitled "Cushioning Conversion Machine Including a Cutting/Aligning Assembly", the entire disclosure of which is hereby incorporated by reference. In the preferred embodiment, the cutting assembly 124 is mounted to the machine's frame 114 and may be viewed as part of the conversion assembly 116.

The stock material is supplied to the forming assembly 120 by a stock supply assembly 126 which is positioned upstream of the forming assembly 120. The illustrated sock supply assembly 126 includes two lateral spaced brackets which are generally shaped like a sideways "U". The lower legs of the brackets include slots which, when rolled stock material is used with the machine 14, cradle a supply rod extending through the core of the stock roll. The upper legs of the brackets cooperate to mount a sheet separator and constant-entry bar. Further details of a suitable stock supply assembly are set forth in co-owned U.S. Pat. No. 4,750,896, which has been incorporated by reference. In the preferred embodiment, the stock supply assembly 126 is mounted to the machine's frame 114 and may be viewed as part of the conversion assembly 116.

The illustrated cushioning conversion machine 14 further includes a post-cutting constraining assembly 128 located downstream of the cutting assembly 124. During the conversion process, a cut section of dunnage will be urged or pushed downstream into the inlet of the assembly 128 by the approaching strip of dunnage. In the preferred embodiment, the post-cutting constraining assembly 128 is mounted to the machine's frame 114 and may be viewed as part of the conversion assembly 116.

One may now appreciate that the present invention provides a cushioning conversion system in which a machine may be selectively rotated relative to a stand in a horizontal plane. Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A cushioning conversion system comprising a stand, a cushioning conversion machine, and a machine mounting assembly;

the cushioning conversion machine comprising a frame, which has an upstream end and a downstream end, and a conversion assembly, mounted to the frame, which converts a sheet-like stock material into a three-dimensional strip of dunnage;

the machine mounting assembly coupling the machine to the stand in such a manner that the machine's frame and conversion assembly are selectively pivotable about a vertical axis relative to the stand in a horizontal plane without uncoupling the machine from the stand.

2. A cushioning conversion system as set forth in claim 1 wherein the stand comprises a vertical member and wherein the machine mounting assembly is rotatably coupled to the vertical member.

3. A cushioning conversion system as set forth in claim 1 wherein the machine is positioned in a substantially horizontal orientation whereby an imaginary line from frame's upstream end to its downstream end is substantially horizontal.

4. A cushioning conversion system as set forth in claim 1 wherein the machine mounting assembly, and thus the machine, is vertically adjustable relative to the stand.

5. A cushioning conversion system as set forth in claim 1 wherein the machine mounting assembly comprises a shelf on which the machine is situated.

6. A cushioning conversion system as set forth in claim 1 wherein the machine may be pivoted 360° in horizontal plane relative to the stand.

7. A cushioning conversion system as set forth in claim 1 wherein the machine mounting assembly includes a first set of components which mate with any one of a second set of components to secure the machine mounting assembly, and thus the machine, in a plurality of rotational positions in the horizontal plane.

8. A cushioning conversion system as set forth in claim 7 wherein the machine mounting assembly includes a coupling unit which is circular in cross-section and wherein the second set of components are circumferentially spaced on the coupling unit in a horizontal plane.

9. A cushioning conversion system as set forth in claim 8 wherein the second set of components are equally circumferentially spaced on the coupling unit approximately 90° apart.

10. A cushioning conversion system as set forth in claim 7 wherein the first set of components includes an insertion member and wherein the second set of components define a plurality of openings into which the insertion member may be inserted.

11. A cushioning conversion system as set forth in any of claims 1–7 wherein the conversion assembly includes:

a forming assembly which forms the sheet-like stock material into the three-dimensional strip of dunnage; and a feed assembly which advances the sheet-like stock material through the forming assembly.

12. A cushioning system as set forth in claim 11 further comprising a supply assembly, positioned upstream of the forming assembly, which supplies the stock material to the forming assembly; and a cutting assembly, positioned downstream of the forming assembly, which cuts the strip of dunnage into sections of a desired length.

13. A cushioning conversation system as set forth in claim 12 wherein the cutting assembly is mounted to machine's frame.

14. A cushioning system as set forth in claim 12 wherein the stock supply assembly is mounted to the machine's frame.

15. A cushioning conversion system as set forth in claim 1 wherein the conversion assembly includes a forming assembly which forms the sheet-like stock material in the three-dimension strip of dunnage, and a feed assembly which advances the sheet-like stock material through the forming assembly; and wherein the feed assembly is mounted to the frame downstream of the forming assembly and pulls the stock material through the forming assembly.

16. A cushioning conversion system as set forth in claim 15 wherein the feed assembly also connects the continuous strip of dunnage.

17. A cushioning system as set forth in claim 16 wherein the feed assembly comprises a pair of gears.

* * * * *